US005156310A

United States Patent [19]

Biedenharn, Jr.

[11] Patent Number: 5,156,310

[45] Date of Patent: Oct. 20, 1992

[54] COMBINATION BACKPACK AND STOOL

[76] Inventor: Eric C. Biedenharn, Jr., P.O. Box 669, Vicksburg, Miss. 39181-0669

[21] Appl. No.: 739,335

[22] Filed: Aug. 1, 1991

[51] Int. Cl.[5] ..... A45F 4/02

[52] U.S. Cl. ..... 224/155; 297/129; 297/192; 297/458; 224/209

[58] Field of Search ..... 224/155, 153, 151; 297/458, 192, 461, 462, 129, 18, 17, 191; 248/431, 164

[56] References Cited

U.S. PATENT DOCUMENTS

| | | | |
|---|---|---|---|
| 2,843,185 | 7/1958 | Clem et al. | 248/164 |
| 2,922,465 | 1/1960 | Johansson et al. | 224/155 |
| 3,527,498 | 9/1970 | Werner | 297/458 |
| 3,662,932 | 5/1972 | Kerschner | 224/155 |
| 3,730,294 | 5/1973 | Thurmond | 182/20 |
| 3,902,640 | 9/1975 | Geiben | 224/245 X |
| 4,392,598 | 7/1983 | Dixon | 224/155 |
| 4,489,866 | 12/1984 | Korte | 224/155 |
| 4,607,882 | 8/1986 | Opsuih | 297/458 X |
| 4,676,548 | 6/1930 | Bradbury | 297/129 |
| 4,694,979 | 9/1987 | Ables | 224/151 |
| 4,773,574 | 9/1988 | Burgard | 224/155 |
| 4,955,517 | 9/1990 | Maresca | 224/155 |
| 5,062,557 | 11/1991 | Mahui et al. | 297/129 X |

FOREIGN PATENT DOCUMENTS

| | | | |
|---|---|---|---|
| 163437 | 12/1985 | European Pat. Off. | 297/458 |
| 79433 | 11/1951 | Norway | 224/155 |
| 103353 | 2/1924 | Switzerland | 224/155 |
| 699602 | 11/1953 | United Kingdom | 224/155 |
| 2023412 | 1/1980 | United Kingdom | 224/155 |

*Primary Examiner*—Henry J. Recla
*Assistant Examiner*—Glenn T. Barrett
*Attorney, Agent, or Firm*—Nixon & Vanderhye

[57] ABSTRACT

A combination backpack and stool is provided with a frame having a seat-defining member upon which a user may sit, a ground-engageable member for supporting the frame upon a surface, and an upright pedestal member rigidly coupled to and between the seat-defining member and the ground-engageable member so as to establish a space therebetween. A flexible material encloses the defined space to provide a storage compartment for articles. A pair of shoulder straps are attached to the frame and thus allow a user to carry the frame in the form of a backpack.

When periodically resting, however, the frame may be set upon the ground so that the user can sit and rest upon the seat-defining member.

11 Claims, 1 Drawing Sheet

COMBINATION BACKPACK AND STOOL

FIELD OF THE INVENTION

The present invention generally relates to backpacks. More specifically, the present invention relates to backpacks having the capability of also serving as a stool for the user.

BACKGROUND AND SUMMARY OF THE INVENTION

Backpacks are notoriously well known articles used in a variety of daily activities. For example, backpacks are typically used in outdoors activities (e.g., camping, hiking, rock climbing, fishing and the like) as a means of carrying articles the participant needs for the particular activity in which he or she is involved.

It is desirable and sometimes necessary for the participant to rest periodically during outdoors activities, especially when the outdoor activities involve strenuous physical exercise. However, oftentimes, the participant in the outdoors activity does not have a convenient and/or comfortable place to rest. Thus, it would be desirable if some means were available that was sufficiently transportable so as to be usable in outdoors activities, while at the same time providing the participant in the outdoors activities with a convenient and comfortable place to rest. Furthermore, it would be highly desirable if such means also enabled the participant to carry articles needed for the particular outdoors activity. It is towards fulfilling such a need that the present invention is directed.

Broadly, the present invention is embodied in a combination backpack and stool. Thus, the present invention not only provides sufficient storage compartments so as to allow a participant to carry articles needed for particular outdoors activities, but also is adapted to bear the weight of the participant so that he or she may sit, and thereby rest, periodically.

According to one preferred embodiment, the combined backpack and stool will include a generally I-shaped rigid frame having substantially horizontally disposed opposing ground-engageable and seat-defining flanges, and a generally vertically disposed pedestal web support flange immovably separating the ground-engageable and the seat-defining flanges. Spaces are thereby established between the separated ground-engageable and seat-defining flanges which are enclosed by a flexible fabric-like material (e.g., canvas, film or sheets of plastics material, and the like) so as to define storage compartments in which articles may be placed, carried and accessed during the outdoors activities. A pair of shoulder straps is secured to the frame at laterally spaced locations so the participant may carry the frame on his or her back.

Another preferred embodiment of this invention includes a rigid frame which is formed of a seat-defining surface, opposing pairs of ground-engageable legs, and a pedestal support column which separates the seat-defining surface from the leg pairs and thereby establish a space therebetween. A flexible fabric-like material may thus be connected to the seat-defining surface and the leg pairs so as to enclosed the space defined thereby and thus establish a storage compartment in which articles may be placed. A pair of laterally spaced straps attached to the frame and extending between the seat-defining surface and the ground-engageable legs enable the frame to be carried upon a person's back.

Further aspects and advantages of this invention will become more clear after careful consideration is given to the detailed description of the preferred exemplary embodiments thereof which follow.

BRIEF DESCRIPTION OF THE DRAWINGS

Reference will be made to the accompanying drawings which will be referenced below in connection with the detailed description of the preferred exemplary embodiments, and wherein.

DETAILED DESCRIPTION OF THE DRAWINGS

Figure 1:
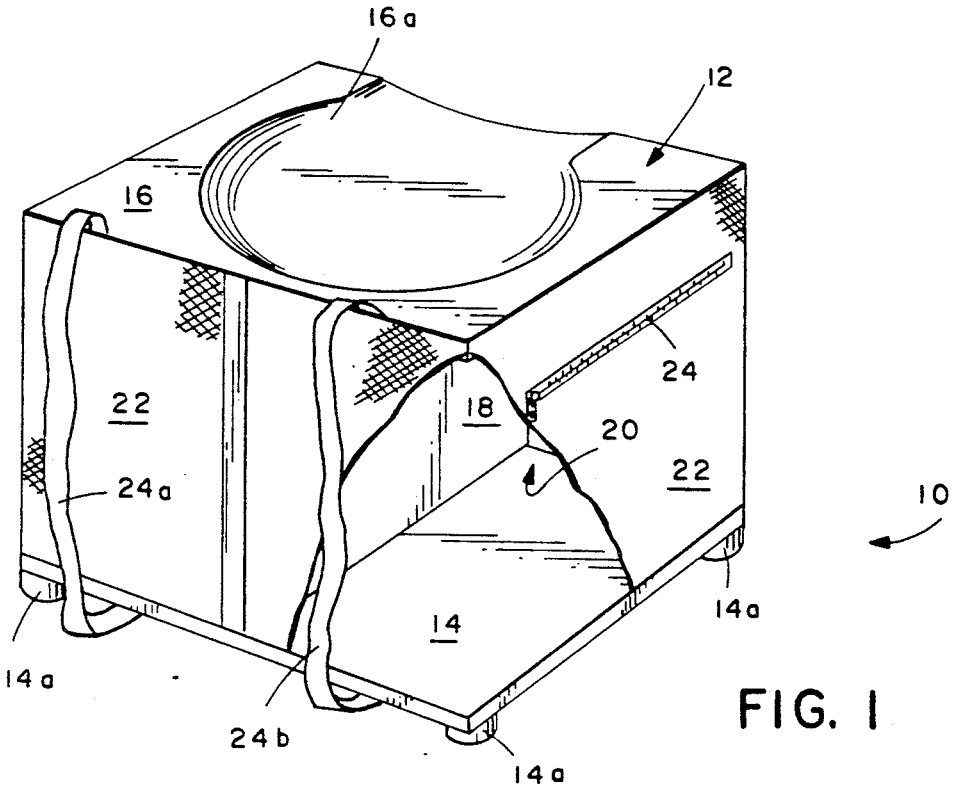
FIG. 1 is a top perspective view of one preferred embodiment of a combination backpack and stool according to this invention showing the fabric-like material partially removed for purposes of presentation clarity.

One preferred embodiment of a combination backpack/stool device 10 according to the present invention is shown in accompanying FIG. 1. As is seen, the device 10 includes a rigid I-beam shaped frame 12 of sufficient strength to support the weight of a user. The frame 12 thereby includes a lower ground-engageable flange 14, an upper seat-defining flange 16, and an upright pedestal web support flange 18. The pedestal web support flange 18 thus provides rigid vertical separation between the lower and upper flanges 14 and 16, respectively, so as to establish spaces 20 on lateral sides of the pedestal flange 18.

Most preferably, the upper seat-defining flange 16 will include a slight concavity **16*a* in its upper surface so as to provide a more comfortable seat for the user. In addition, the lower ground-engageable flange 14 will preferably (but not necessarily) be provided with footpads 14*a*** which serve to maintain the lower flange in spaced-relationship to the ground upon which it rests.

Flexible sheet material 22 (e.g., canvas, film or sheets of plastics material and the like) is joined at or near the perimetrical edges of the upper and lower flanges 16, 14, respectively and preferably to each side edge of the pedestal flange 18. The sheet material 22 thereby encloses the spaces 20 and thus establishes a convenient storage compartment for carrying needed articles therewithin. Access to the spaces is provided by one or more access openings formed in the sheet material 22 which may be closed by any suitable closure device, for example, by means of a zipper 24 shown in FIG. 1. Other equivalent closure devices may of course be employed, such as buttons, snaps, and/or Velcro® loop-and-pile fasteners, to name just a few.

A pair of shoulder straps **24*a*, 24*b* are affixed to the frame 12 laterally of the pedestal flange 18 so as to enable the user to carry the frame upon his or her back when desired. Preferably, the straps 24*a*, 24*b* are provided with any conventional means (not shown) which enable the adjustment of the strap length to suit the particular user. Moreover, preferably one end of the straps 24*a*, 24*b* is attached to the upper flange 16, while the other end of the straps 24*a*, 24*b* is attached to the lower flange 14**.

Figure 2:
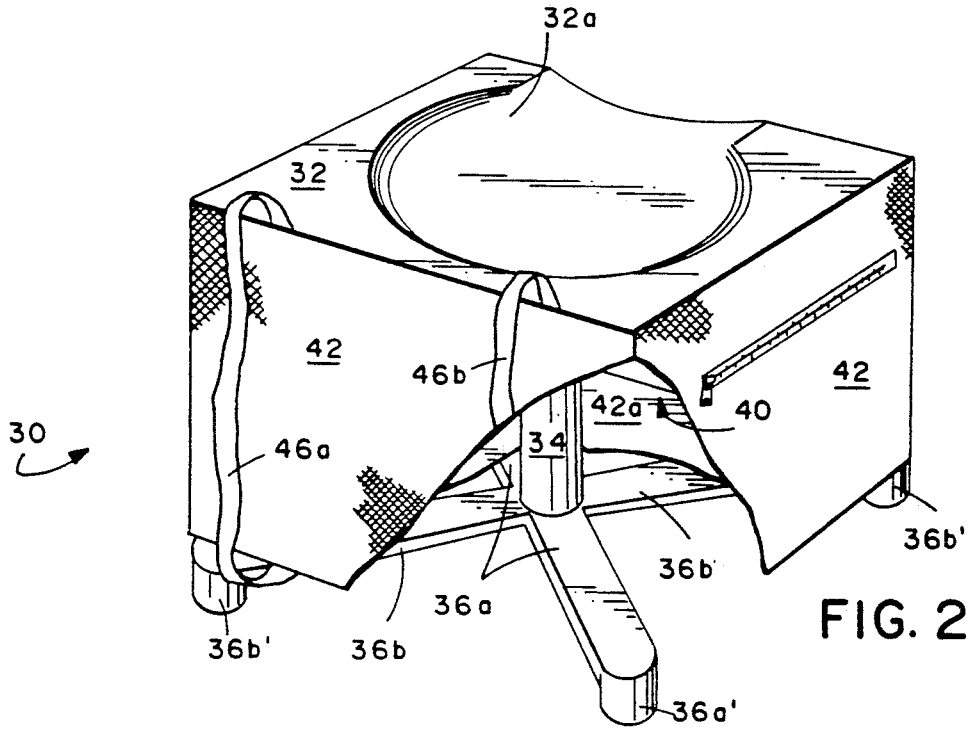
FIG. 2 is a top perspective view of another preferred embodiment of this invention whereby a portion of the fabric-like material is removed for purposes of presentation clarity.

Another embodiment of a combined backpack/stool device 30 according to this invention is shown in accompanying FIG. 2. As is noted, the device 30 is similar to the backpack device 10 described previously in that it has a rigid upper seat-defining flange 32 (preferably having a concavity 32*a* in its upper surface) and an upright central pedestal column 34. The pedestal column extends from the crossing region of a pair of opposed legs 36*a*, 36*b* so as to separate the upper flange 32 from the leg pairs 36*a*, 36*b* and thereby establish a space 40 therebetween. The leg pairs 36*a*, 36*b* each terminate in a downwardly turned foot 36*a*', 36*b*', respectively, so as to bear against a surface upon which the device 30 rests and to maintain separation of the leg pairs 36*a*, 36*b* with that surface.

A fabric material 42 is attached at or near the perimetrical edge of the upper flange 32. The opposed pairs of side panels of fabric material 42 thus bounds sides of the space 40. Furthermore, the fabric material 42, according to the embodiment shown in FIG. 2, has a bottom panel 42*a* which establishes the bottom-most extent of the space 40. Thus, the opposed side panels of the fabric material 42, its bottom panel 42*a*, and the upper flange 32 collectively establish the bounds of the space 40 so as to provide an interior storage compartment in which articles may be carried.

One or more access openings may be provided in the fabric material so that the contents of the storage compartment provided by means of space 40 may be accessed. As represented in FIG. 2, the access opening may be closed, for example, by a zipper 44, or any other suitable closure means as mentioned above with respect to the embodiment depicted in FIG. 1.

The device 30 further includes a pair of laterally separated straps 46*a*, 46*b* (which are preferably length-adjustable) to enable the device 30 to be carried upon a user's back in the form of a back-pack.

The frame assemblies of the devices described above are preferably formed of a lightweight plastics material. In this regard, the frame is most preferably a one-piece molded plastics structure, but multiple pieces may be provided and assembled (e.g., via adhesive and/or heat- or ultrasonic-welding) to form an integral rigid frame assembly. The fabric material and straps may then be attached to the frame assemblies to complete the fabrication of the devices according to this invention. The fabric material may be permanently affixed to the frame assemblies, or alternatively, may be provided as a removable component (e.g., by means of buttons, snaps, Velcro® loop-and-pile fasteners, or the like) so that replacement of damages and/or worn fabric material can be more easily accomplished.

Therefore, while the present invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combination backpack and stool comprising:

a frame having a seat-defining member upon which a user may sit, a ground-engageable member for supporting the frame upon a surface, and an upright pedestal member rigidly coupled to and between said seat-defining member and said ground-engageable member so as to establish a space therebetween;

a flexible material connected to said frame and enclosing said defined space to provide a storage compartment for articles; and a pair of shoulder straps connected to said frame to allow carrying of said combination stool and backpack upon a user's back; wherein said frame is in the form of an I-beam structure having upper and lower generally parallel flanges providing said seat-defining member and said ground-engageable member, respectively, and a central web support flange rigidly joined to and separating said upper and lower flanges.

2. A combination stool as in claim 1, wherein said fabric material includes an access opening, and means for closing said access opening.

3. A combination stool and backpack as in claim 1 wherein said ground-engageable member includes feet for engaging a surface upon which the frame rests.

4. A combination stool and backpack as in claim 1, wherein said frame is a one-piece structure formed of a plastic material.

5. A combination backpack and stool comprising:

a one-piece frame structure having upper and lower generally horizontal flanges and a generally vertical central pedestal flange separating said upper and lower flanges;

flexible material connected to said frame structure so as to enclose spaces defined between said upper and lower generally horizontal flanges laterally of said central pedestal flange; and a pair of carrying straps attached to said frame structure to allow said frame structure to be carried upon a person's back; wherein said lower horizontal flange includes feet for engaging a surface upon which the frame rests.

6. A combination backpack and stool as in claim 5, wherein said fabric material includes an access opening, and means for closing said access opening.

7. A combination backpack and stool comprising:

a one-piece frame structure having upper and lower generally horizontal flanges and a generally vertical central pedestal flange separating said upper and lower flanges;

flexible material connected to said frame structure so as to enclose spaces defined between said upper and lower generally horizontal flanges laterally of said central pedestal flange; and a pair of carrying straps attached to said frame structure to allow said frame structure to be carried upon a person's back; wherein said frame structure is a one-piece structure formed of a plastics material.

8. A combination backpack and stool as in claim 7, wherein said fabric material includes an access opening, and means for closing said access opening.

9. A combination backpack and stool and in claim 7, wherein said upper flange includes a concavity in an upper surface thereof.

10. A combination backpack and stool comprising:

a one-piece frame structure having upper and lower generally horizontal flanges and a generally vertical central pedestal flange separating said upper and lower flanges;

flexible material connected to said frame structure so as to enclose spaces define between said upper and lower generally horizontal flanges laterally of said central pedestal flange; and a pair of carrying straps attached to said frame structure to allow said frame structure to be carried upon a person's back; wherein said upper flange includes a concavity in an upper surface thereof.

11. A combination backpack and stool as in claim 10, wherein said fabric material includes an access opening, and means for closing said access opening.

* * * * *